US010605085B2

(12) United States Patent
Jung

(10) Patent No.: US 10,605,085 B2
(45) Date of Patent: Mar. 31, 2020

(54) GAS TURBINE DISK

(71) Applicant: DOOSAN HEAVY INDUSTRIES & CONSTRUCTION CO., LTD., Gyeongsangnam-do (KR)

(72) Inventor: Sunghul Jung, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 523 days.

(21) Appl. No.: 15/212,133

(22) Filed: Jul. 15, 2016

(65) Prior Publication Data

US 2017/0096899 A1 Apr. 6, 2017

(30) Foreign Application Priority Data

Oct. 2, 2015 (KR) ..... 10-2015-0139136

(51) Int. Cl.
*F01D 5/08* (2006.01)

(52) U.S. Cl.
CPC ..... *F01D 5/087* (2013.01); *F01D 5/082* (2013.01); *F05D 2220/32* (2013.01)

(58) Field of Classification Search
CPC ..... F01D 5/087; F01D 5/082; F05D 2220/32
See application file for complete search history.

(56) References Cited

U.S. PATENT DOCUMENTS 3,343,806 A * 9/1967 Bobo ..... F01D 5/06 415/115
6,185,924 B1 * 2/2001 Matsumoto ..... F01D 5/082 415/110
6,506,021 B1 * 1/2003 Wilson ..... F01D 5/08 415/115
7,160,078 B2 * 1/2007 Coign ..... F01D 9/041 29/889.22
8,770,919 B2 * 7/2014 Hashimoto ..... F01D 5/087 415/115

(Continued)

FOREIGN PATENT DOCUMENTS

DE 102011100221 A1 11/2012
EP 1450005 A1 8/2004

(Continued)

OTHER PUBLICATIONS

An extended European Search Report issued by the European Patent Office dated Feb. 8, 2017 in connections with European Application No. 16180337.4., which corresponds to the above-mentioned U.S. application.

(Continued)

*Primary Examiner* — Dwayne J White
*Assistant Examiner* — Adam W Brown
(74) *Attorney, Agent, or Firm* — Invenstone Patent, LLC

(57) ABSTRACT

The present disclosure relates to a plurality of disks, on which outer circumferential surfaces a plurality of blades are arranged, and has an objective to provide a gas turbine disk including a plurality of cooling channels penetrating the side surfaces of the disks and spaced from each other in a circumferential direction, and reinforcement parts coupled to partial arcs of exits of the cooling channels so as to reduce stress concentrated on the cooling channels.

10 Claims, 5 Drawing Sheets

(56) References Cited

U.S. PATENT DOCUMENTS

| | | | | |
|---|---|---|---|---|
| 8,899,913 | B2 * | 12/2014 | Bonneau | F01D 5/066 415/115 |
| 2006/0120855 | A1 | 6/2006 | Djeridane et al. | |
| 2011/0129336 | A1 * | 6/2011 | Bonneau | F01D 5/066 415/180 |
| 2017/0097012 | A1 * | 4/2017 | Ortmanns | F04D 19/02 |

FOREIGN PATENT DOCUMENTS

| | | | |
|---|---|---|---|
| JP | 58143101 | A | 8/1983 |
| JP | 60093101 | A | 5/1985 |
| JP | 62-225701 | A | 10/1987 |
| JP | 62225701 | A | 10/1987 |
| JP | 2001234701 | A | 8/2001 |
| KR | 20010007232 | A | 1/2001 |
| WO | 2010088882 | A2 | 8/2010 |

OTHER PUBLICATIONS

Office Action issued in corresponding Korean Application No. 10-2015-0139136, dated Jul. 20, 2016, 3 pages.
Notice of Allowance issued in corresponding Korean Application No. 10-2015-0139136, dated Sep. 23, 2016, 3 pages.

* cited by examiner

GAS TURBINE DISK

CROSS-REFERENCE TO RELATED APPLICATIONS

This application claims priority to Korean Application No. 10-2015-0139136, filed Oct. 2, 2015, the contents of which are incorporated herein in their entirety.

BACKGROUND

The present disclosure relates to a disk of a gas turbine and, more particularly, to a structure of a bore part of a gas turbine, in which a groove is provided to the bore part.

In general, a gas turbine includes a compressor, a combustor and a turbine. Air is introduced through an air inlet and compressed by the compressor so as to be compressed air of high temperature and high pressure. Fuel is supplied with respect to the compressed air by the combustor so as to be burned. The combustion gas of high temperature and high pressure drives the turbine and thus drives a generator connected to this turbine.

The turbine is formed of a plurality of stators and a plurality of rotors, which are arranged alternately, in a cabin, wherein the rotors are driven by the combustion gas so as to rotate an output shaft connected to the generator. In addition, the combustion gas, which drives the turbine, is converted into static pressure by a diffuser in an exhaust cabin and then discharged into the atmosphere.

According to recent demands for a gas turbine of a high output and high efficiency, there is a tendency that the temperature of the combustion gas induced into the stators and the rotors is gradually increased. Therefore, typically, cooling paths are formed in the stators and the rotors and a cooling medium is induced to flow through the cooling paths so as to cool the stators and the rotors, thereby securing heat resistance while facilitating the increase of the combustion gas temperature as well as improving an output and efficiency.

Referring to FIG. 1, a turbine disk 10 has a cooling channel 11 formed along the radial direction thereof and the front end portion of the cooling channel communicates with a cooling path 12 of a stator main body. In addition, a cooling medium is supplied from a base part with respect to the cooling channel and flows through ugh this cooling channel, thereby cooling the main body of a rotor 20.

However, such a cooling channel respectively has a portion to which stress is concentrated in the circumferential direction or the radial direction of the turbine disk. Therefore, there is a problem that the tensile stress has to be minimized.

BRIEF SUMMARY

Accordingly, the present disclosure has been made to solve the above-mentioned problems occurring in the related art, and it is an objective of the present disclosure to provide a gas turbine disk, in which a reinforcement part is provided to a cooling channel of a gas turbine disk so as to induce stress decrease at a position where the stress has been conventionally concentrated in the circumferential direction or the radial direction of the turbine disk, thereby improving or maximizing the lifespan of the disk.

To accomplish the above objective, according to an embodiment of the present disclosure, it is conceivable to provide a gas turbine disk, comprising: in a plurality of disks, on which outer circumferential surfaces a plurality of blades are arranged, a plurality of cooling channels penetrating side surfaces of the disks and spaced from each other in a circumferential direction; and reinforcement parts coupled to partial arcs of exits of the cooling channels so as to reduce stress concentrated on the cooling channels.

According to an embodiment of the present disclosure, it is conceivable that the reinforcement part is formed in a polygonal or circular shape so as to entirely encompass the exit of a cooling channel and protrudes in the axial direction of a disk.

According to an embodiment of the present disclosure, it is conceivable that the reinforcement part is formed to directly connect one cooling channel to another cooling channel, which is adjacent to the one cooling channel, and protrudes in the axial direction of a disk.

According to an embodiment of the present it is conceivable that the reinforcement part continuously encompasses the exit of a cooling channel along the circumferential surface of the exit of the cooling channel.

According to an embodiment of the present disclosure, it is conceivable that reinforcement parts are continuously formed along the circumference formed by the exits of a plurality of cooling channels.

According to an embodiment of the present disclosure, it is conceivable that reinforcement parts are formed in the shape of a circle, a rectangle or any other polygon.

According to the present invention as described above, the reinforcement part is provided to the cooling channel of the disk of a gas turbine so as to induce the decrease of stress concentration, thereby increasing the lifespan of the disk.

DETAILED DESCRIPTION

Reference will be now made in detail to the preferred embodiments of the present disclosure with reference to the attached illustrative drawings. It should be noted that, in adding reference signs to the constituent elements in each of the drawings, the same constituent elements have the same reference signs even though they are illustrated in different figures. In addition, in the description of the present disclosure, when it is judged that detailed descriptions of known functions or structures may make the essential points vague, the detailed descriptions of the known functions or structures will be omitted.

Further, in the description of the constituent elements of the embodiments of the present disclosure, it is possible to use terms such as first, second, A, B, (a), (b) and the like. These terms are just to distinguish the constituent elements from any other constituent elements but do not limit the nature or sequence or order and the like of corresponding features by the terms. Additionally, it should be also understood that the expression that some constituent element is "connected", "coupled" or "joined" to another constituent element means that some constituent element may be directly connected or joined to another constituent element or is also "connected", "coupled" or "joined" to another constituent element through a further component therebetween.

Figure 3:
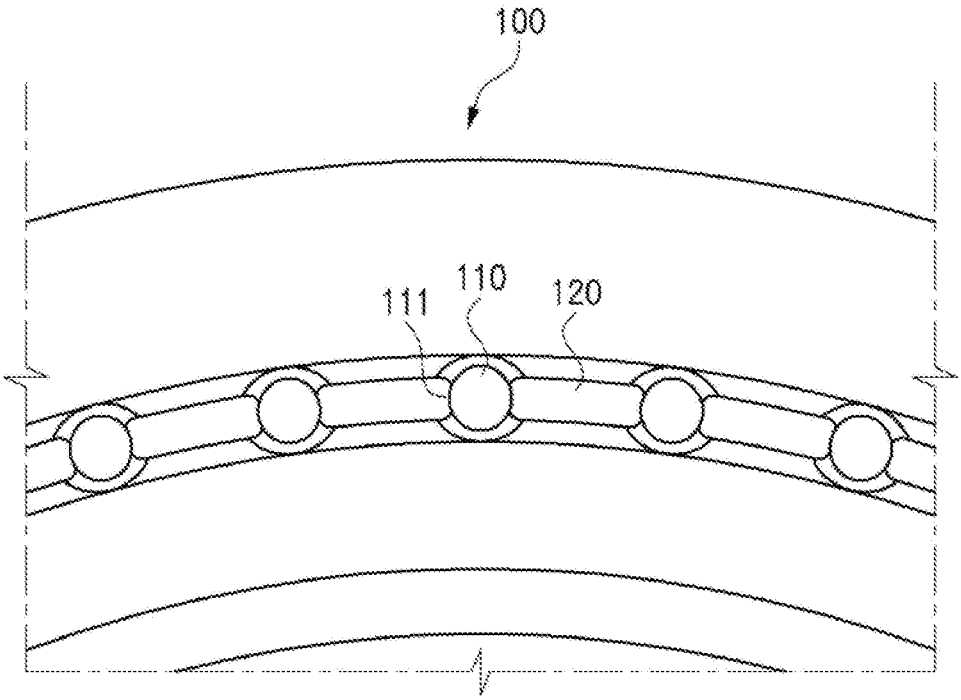
FIG. 3 is a side view of cooling channels and reinforcement parts forming a disk of a gas turbine according to an embodiment of the present disclosure.

FIG. 3 shows cooling channels and reinforcement parts forming a disk of a gas turbine according to an embodiment of the present disclosure.

Figure 4:
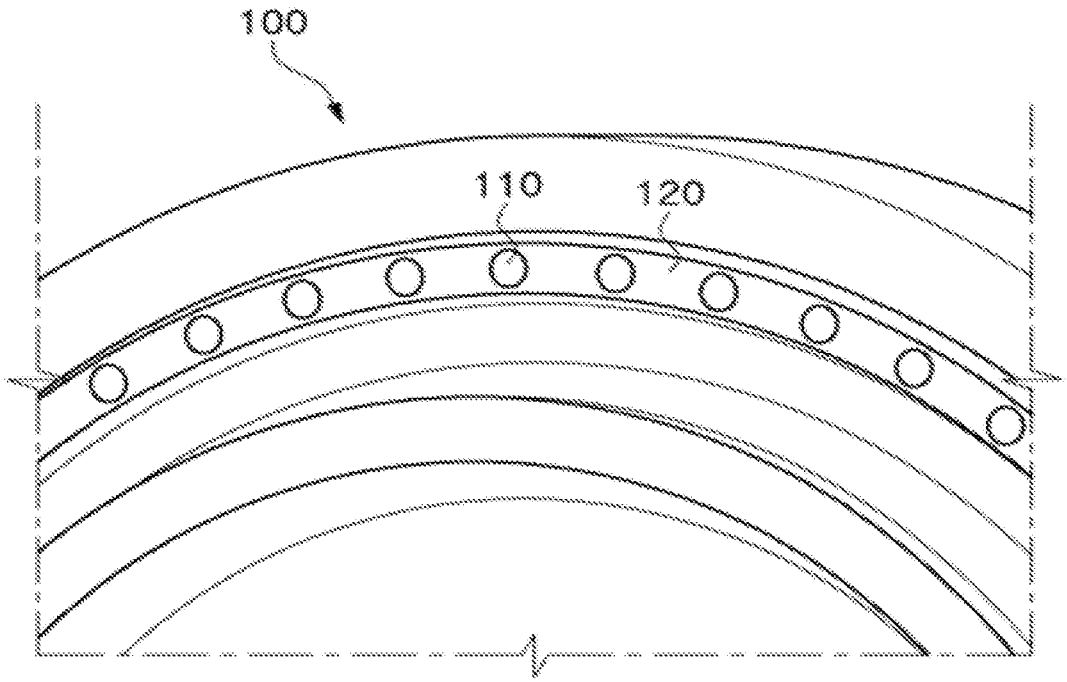
FIG. 4 is a side view of cooling channels and reinforcement parts forming a disk of a gas turbine according to another embodiment of the present disclosure.
Figure 5:
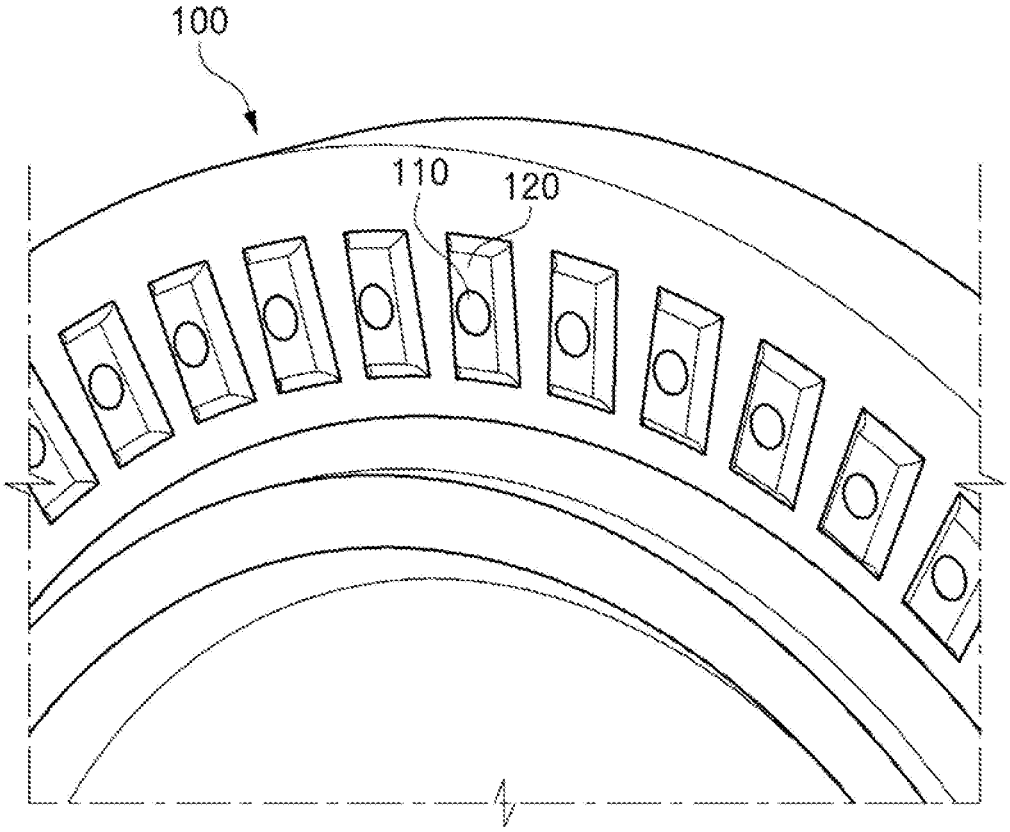
FIG. 5 is a perspective view of cooling channels and reinforcement parts of a disk of a gas turbine according to still another embodiment of the present disclosure.

FIG. 4 shows cooling channels and reinforcement parts forming a disk of a gas turbine according to another embodiment of the present disclosure, and FIG. 5 shows cooling channels and reinforcement parts of a disk of a gas turbine according to still another embodiment of the present disclosure.

BRIEF EXPLANATION OF REFERENCE SIGNS

100: disk
110: cooling channel
111: partial arc
120: reinforcement part As shown in FIG. 3, a gas turbine disk according to an embodiment of the present disclosure may include a disk 100, on which outer circumferential surfaces one or more blades may be arranged, a plurality of cooling channels 110 penetrating side surfaces of the disk 100 and are spaced from each other in a circumferential direction, and reinforcement parts 120 coupled to partial arcs 111 of exits of the cooling channels 110 so as to reduce stress concentrated on the cooling channels 110. It will be appreciated that a gas turbine may include a plurality of the gas turbine disks and a plurality of blades. The plurality of blades may be arranged at outer circumferential surfaces of the plurality of disks.

The cooling channels 110 may be formed penetrating the disk 100 in parallel to the axial direction of the disk 100. That is, the cooling channels 110 are formed through one surface and the other surface of the disk 100 in the axial direction.

The cooling channels 110 may be hollow parts, each of having a cross section in a circular shape. In addition, in order to prevent or reduce the concentration of stress, the cooling channels 110 may be formed as hollow parts, each of which having a cross section oval shape so as to have a long axis in the circumferential direction of the disk 100 or in the radial direction of the disk 100.

The cooling channels 110 are to enable a cooling in medium such as air, steam and the like to flow through the cooling channels 110 so as to cool a stator and a rotor, thereby securing heat resistance while facilitating the increase of combustion gas temperature as well as improving an output and efficiency.

The reinforcement parts 120 may be formed in a buildup shape so as to reinforce the cooling channels in the circumferential direction and in the radial direction.

The reinforcement part 120 according to an embodiment of the present disclosure, as shown in FIG. 3, may be formed in a continuous shape, in which the reinforcement part 120 extends from one end thereof, which is formed at a partial arc 111 of the exit of one cooling channel 110, to the other end, which is formed at a partial arc 111 of the exit of another one cooling channel 110 that is adjacent to the one cooling channel 110. Therefore, the reinforcement parts 120 are formed in a shape, in which the reinforcement parts 120 connect the exits of the cooling channels, which are adjacent to each other, among the plurality of cooling channels.

That is, the shape, in which the respective reinforcement parts 120 and the cooling channels 110 are formed to be continuously connected, may be the shape of a chain when viewing the side surface of the disk 100 on the whole.

Figure 1:
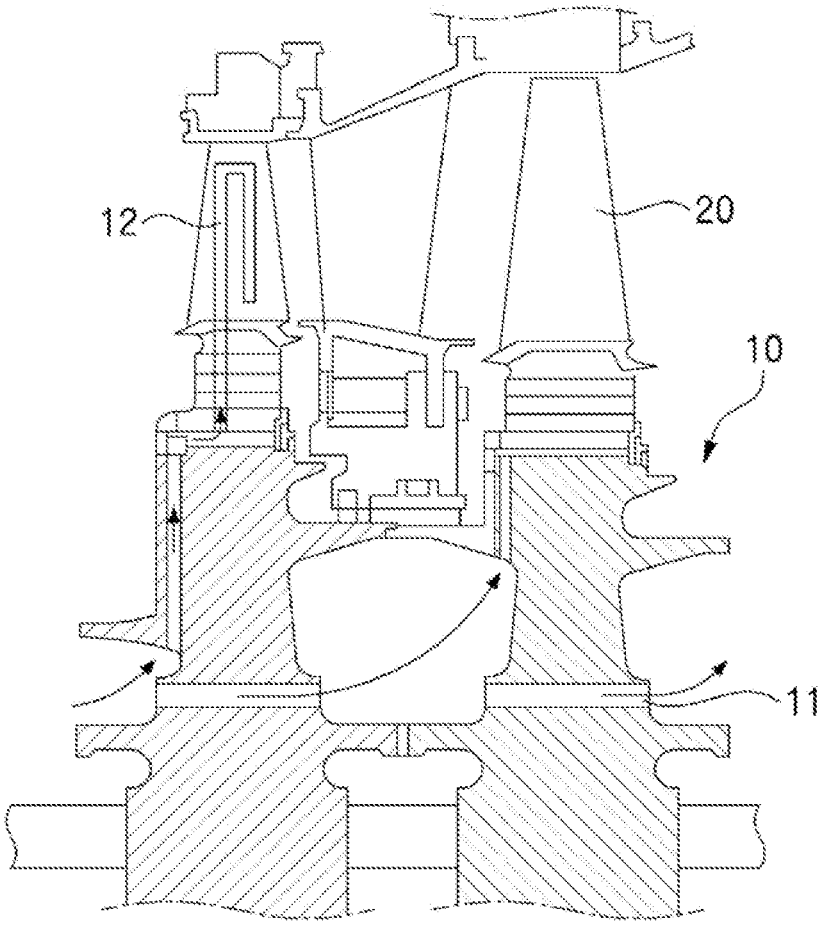
FIG. 1 is a partial cross-sectional view of a related art gas turbine disk.
Figure 2A:
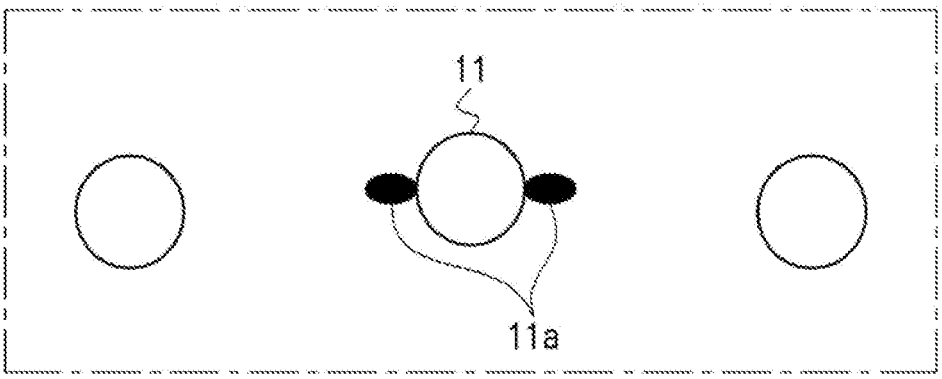
FIG. 2A is a partial cross-sectional view of a cooling channel of a gas turbine disk.

The above described embodiment, as shown in FIG. 2A, may be applied for the reinforcement when the stress 11*a* is concentrated in the circumferential direction of the disk 100.

Further, as shown in FIG. 4, the reinforcement part 120 may be formed to directly connect one cooling channel 110 to another cooling channel 110, which is adjacent to the one cooling channel 110, wherein this reinforcement part 120 may be formed to be protruded in the axial direction of the disk 100.

The reinforcement parts 120 may be up to a preferable level according to the degree of the stress applied to the cooling channels 110.

Figure 2B:
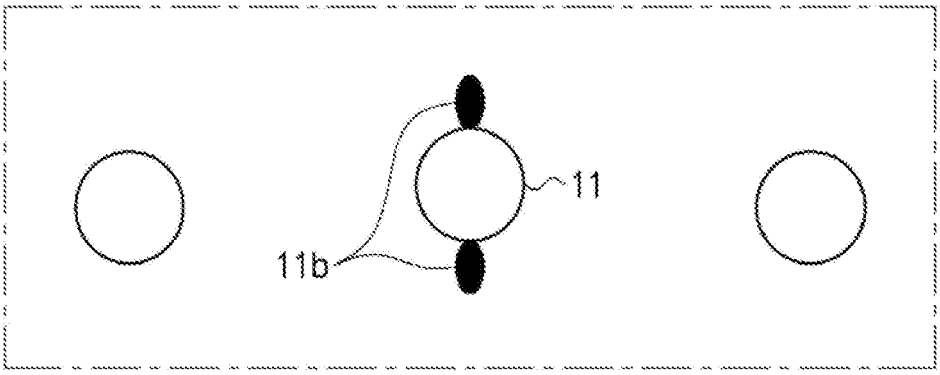
FIG. 2B is a partial cross-sectional view of a cooling channel of a gas turbine disk.

In addition, according to the embodiment, as shown in FIG. 3, the reinforcement part 120 may continuously encompass the exit of the cooling channel 110 along the circumferential surface of the exit, so as to cope with the stress 11*a* concentrated in the circumferential direction of the disk 100 (FIG. 2A) as well as the stress 11*b* concentrated in the radial direction of the disk 100 (FIG. 2B).

The protrusion shape may be variously formed, wherein the thickness of the protrusion is preferably formed according to the stress concentration degree in the same way as the embodiment shown in FIG. 3.

Referring to FIG. 5, the reinforcement part 120 is formed in a polygonal or circular shape so as to entirely encompass the exit, and may be formed to be protruded in the axial direction of the disk 100.

This feature is to make the reinforcement at a position where rigidity reinforcement is most necessary according to the shape of a cooling concentration portion.

According to the embodiment of the present disclosure, as shown in FIG. 5, the reinforcement part is in a shape, in which the length in the radial direction of the disk is long so as to correspond to the stress 11*b* in the radial direction.

The gas turbine disk 100 according to the embodiment of the present embodiment is provided with the reinforcement parts 120 as the protruded buildup parts at the portions to which the stress is concentrated, thereby inducing the decrease of the local peak stress and increasing the low cycle fatigue (LCF) lifespan without requiring laser shock peening (LSP) thereby reducing additional manufacturing processes and reducing the associated manufacturing costs. In addition, the buildup parts, that is, the reinforcement parts 120 may be differently applied to the portions according to whether the circumference direction stress (radial peak stress) or the radial direction stress (tangential peak stress) is applied thereto, thereby maximizing the effect.

Hereinabove, even though all of the constituent elements are coupled into one body or operate in a combined state in the description of the above-mentioned embodiments of the present disclosure, the present disclosure is not limited to these embodiments. That is, all of the constituent elements may operate in one or more selective combination within the range of the purpose of the present invention. It should be also understood that the terms of "include", "comprise" or "have" in the specification are "open type" expressions just to say that the corresponding constituent elements exit and, unless specifically described to the contrary, do not exclude but may include additional components.

All terms, including technical or scientific terms, unless otherwise defined, have the same meaning as commonly understood by those of ordinary skill in the art, to which the present invention belongs. The terms which are commonly used such as the definitions in the dictionary are to be interpreted to represent the meaning that matches the meaning in the context of the relevant art and, unless otherwise defined explicitly in the present invention, it shall not be interpreted to have an idealistic or excessively formalistic meaning.

As described above, while the present invention has been particularly shown and described with reference to the example embodiments thereof, it will be understood by those of ordinary skill in the art that the above embodiments of the present invention are all exemplified and various changes, modifications and equivalents may be made therein without changing the essential characteristics and scope of the present invention.

The embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A gas turbine disk comprising:

side surfaces respectively disposed on opposite sides of the disk in an axial direction, each side surface having two ends and extending contiguously from one end disposed toward a central axis of the disk to the other end integrally formed with an outer circumferential surface of the disk;

a plurality of cooling channels to cool a main body of the disk by passing a cooling fluid from an upstream side to a downstream side of the disk, each cooling channel having an exit communicating with the downstream side of the disk; and a reinforcement part configured to entirely encircle the exit of each cooling channel and to protrude from the disk in the axial direction and thereby increase a thickness of the disk in order to reduce stress concentrated on the cooling channels, the reinforcement part consisting of a plurality of reinforcement parts separately arranged along a circumferential direction of the disk to communicate respectively with each exit of the plurality of cooling channels, wherein each cooling channel of the plurality of cooling channels is surrounded by the disk between the side surfaces and penetrates both of the side surfaces between the two ends of each side surface.

2. The gas turbine disk according to claim 1, wherein the exit of each cooling channel is encircled by and communicates with one of the side surfaces.

3. The gas turbine disk according to claim 2, wherein the plurality of cooling channels include one cooling channel and an adjacent cooling channel spaced apart from the one cooling channel in a circumferential direction, and the reinforcement part is coupled to the exit of each of the one cooling channel and the adjacent cooling channel.

4. The gas turbine disk according to claim 1, wherein the reinforcement part includes a buildup shape integrally formed with a downstream side surface of the disk to thereby increase the thickness of the disk.

5. The gas turbine disk according to claim 4, wherein each of the plurality of reinforcement parts has a cross section that is perpendicular to an axial direction of the disk and that decreases in size as the reinforcement part progresses from the downstream side surface of the disk.

6. The gas turbine disk according to claim 1, wherein each of the plurality of reinforcement parts has a rectangular shape and includes a pair of long sides and a pair of short sides, the long sides facing in the circumferential direction, the short sides facing in a radial direction of the disk.

7. A gas turbine comprising:

a plurality of disks each of which has an outer circumferential surface on which a plurality of blades are arranged, wherein each of the plurality of disks includes:

side surfaces respectively disposed on opposite sides of the disk in an axial direction, each side surface having two ends and extending contiguously from one end disposed toward a central axis of the disk to the other end integrally formed with the outer circumferential surface of the disk;

a plurality of cooling channels to cool a main body of the disk by passing a cooling fluid from an upstream side to a downstream side of the disk, each cooling channel having an exit communicating with the downstream side of the disk; and a reinforcement part configured to entirely encircle the exit of each cooling channel and to protrude from the disk in the axial direction and thereby increase a thickness of the disk in order to reduce stress concentrated on the cooling channels, the reinforcement part consisting of a plurality of reinforcement parts separately arranged along a circumferential direction of the disk to communicate respectively with each exit of the plurality of cooling channels, wherein each cooling channel of the plurality of cooling channels is surrounded by the disk between the side surfaces and penetrates both of the side surfaces between the two ends of each side surface.

8. The gas turbine according to claim 7, wherein the plurality of disks include one disk and an adjacent disk arranged downstream of the one disk in the axial direction, and wherein the cooling channels of the one disk pass the cooling fluid from an upstream of the one disk to an upstream side of the adjacent disk.

9. The gas turbine according to claim 7, wherein the plurality of disks include a pair of adjacent disks arranged in the axial direction, and wherein each cooling channel communicates with a downstream side of one disk of the pair of adjacent disks and with an upstream side of the other disk of the pair of adjacent disks.

10. A gas turbine disk comprising:

a main body having side surfaces respectively disposed on opposite sides of the disk in an axial direction, each side surface having two ends and extending from one end disposed toward a central axis of the disk to the other end integrally formed with an outer circumferential surface of the disk;

a plurality of cooling channels to cool the main body of the disk by passing a cooling fluid from an upstream side to a downstream side of the disk, each cooling channel penetrating both of the side surfaces between the two ends of each side surface and having an exit communicating with the downstream side of the disk, the plurality of cooling channels arranged in a circumferential direction of the disk so as to comprise at least one pair of adjacent cooling channels; and a reinforcement part coupled to only a partial arc of each exit of the at least one pair of adjacent cooling channels and configured to protrude from the disk in the axial direction and thereby increase a thickness of the disk in order to reduce stress concentrated on the cooling channels, the reinforcement part consisting of a plurality of reinforcement parts separately arranged along the circumferential direction to communicate respectively with each exit of the plurality of cooling channels.

* * * * *